United States Patent [19]

Miller et al.

[11] 4,220,077

[45] Sep. 2, 1980

[54] COMPOSITE CAN REGISTRATION

[75] Inventors: Peter S. Miller, Waterville; Jerry D. Schermerhorn, Swanton, both of Ohio

[73] Assignee: Owens-Illinois, Inc., Toledo, Ohio

[21] Appl. No.: 889,158

[22] Filed: Mar. 22, 1978

[51] Int. Cl.[2] ..... B31C 3/00

[52] U.S. Cl. ..... 93/80; 83/38; 83/288; 83/318

[58] Field of Search ..... 93/80; 83/37, 38, 288, 83/318, 320; 156/425, 426

[56] References Cited

U.S. PATENT DOCUMENTS

| | | | |
|---|---|---|---|
| 3,133,483 | 5/1964 | Glasby | 93/80 |
| 3,150,574 | 9/1964 | Glasby | 93/80 |
| 3,150,575 | 9/1964 | Couzens et al. | 93/80 |
| 3,158,074 | 11/1964 | Brigham | 93/80 |
| 3,220,320 | 11/1965 | Brigham | 93/80 |

*Primary Examiner*—Z. R. Bilinsky

*Attorney, Agent, or Firm*—John R. Nelson; Myron E. Click; David H. Wilson

[57] ABSTRACT

An improved control system for the cutting of spirally wound composite can "sticks" with accurate registration. Cutting knives, which cut a wound tube into sticks, are mounted on a servo-driven sled, which is in turn mounted on a reciprocating carriage. The point of cutting is controlled by adjusting the position of the carriage (for long term errors) and the sled (for short term errors). Factors analyzed to determine where the carriage and sled should be positioned include the phase relationship between the label and the carriage, the angle at which the label is wound onto the tube, the point at which the label is wound onto the tube, label stretch, and misprinting of reference marks on the label. Means may be included for automatically rejecting sticks which are out of registration.

29 Claims, 9 Drawing Figures

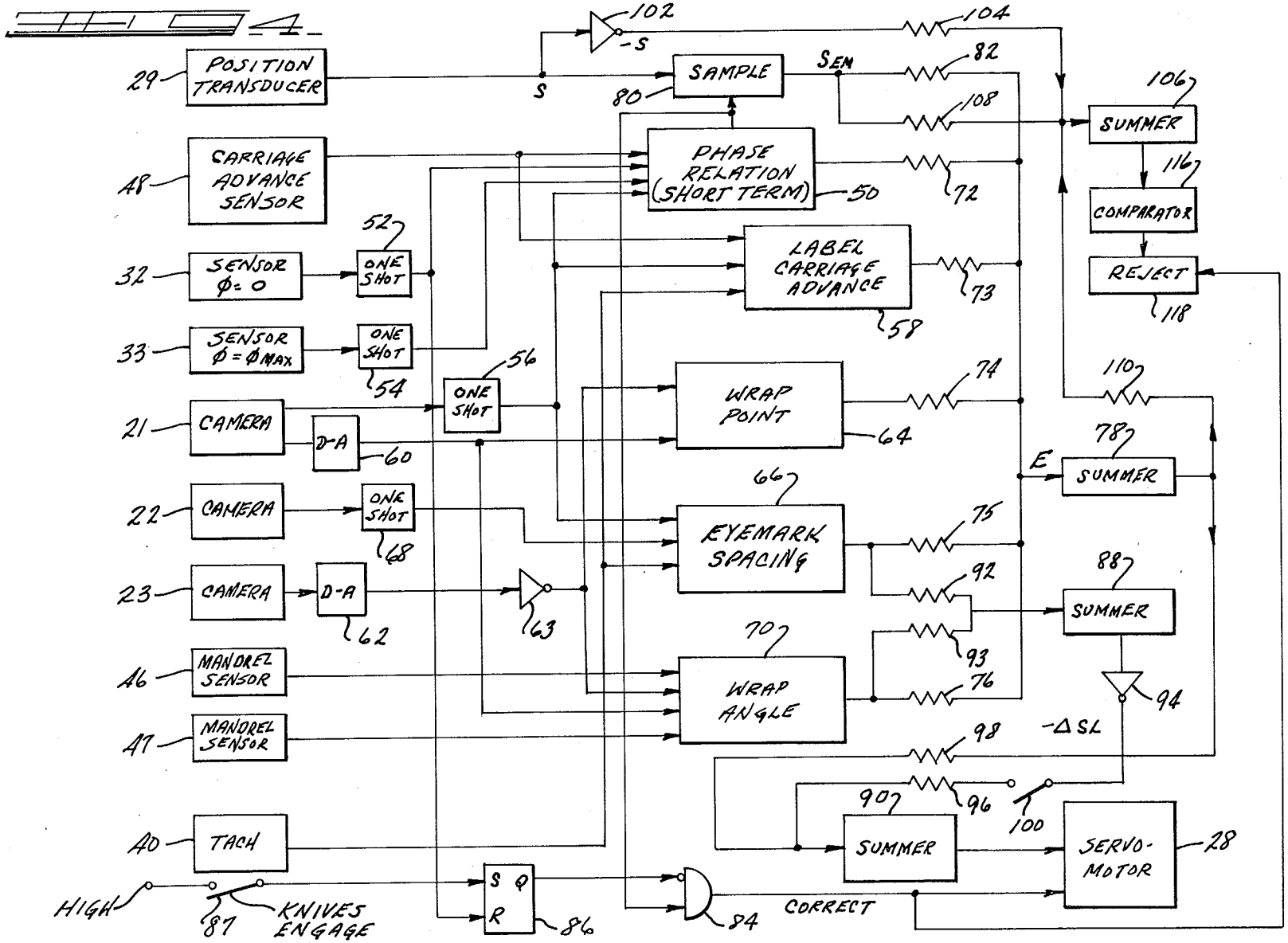
POSITION TRANSDUCER
29
CARRIAGE ADVANCE SENSOR
48
SENSOR Φ=0
32
SENSOR Φ=ΦMAX
33
CAMERA
21
CAMERA
22
CAMERA
23
MANDREL SENSOR
46
MANDREL SENSOR
47
TACH
40
HIGH
KNIVES ENGAGE
87
ONE SHOT
52
ONE SHOT
54
ONE SHOT
56
ONE SHOT
58
D-A
60
D-A
62
63
S Q
R
86
SAMPLE
80
PHASE RELATION (SHORT TERM)
50
LABEL CARRIAGE ADVANCE
59
WRAP POINT
64
EYEMARK SPACING
66
WRAP ANGLE
70
SUMMER
78
SUMMER
88
SUMMER
90
SUMMER
106
COMPARATOR
116
REJECT
118
SERVO-MOTOR
28
CORRECT
84
-ΔSL
E
SEN
S
-S
102
104
82
108
72
73
74
75
92
93
76
98
96
100
94
110

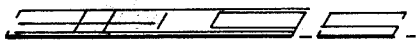
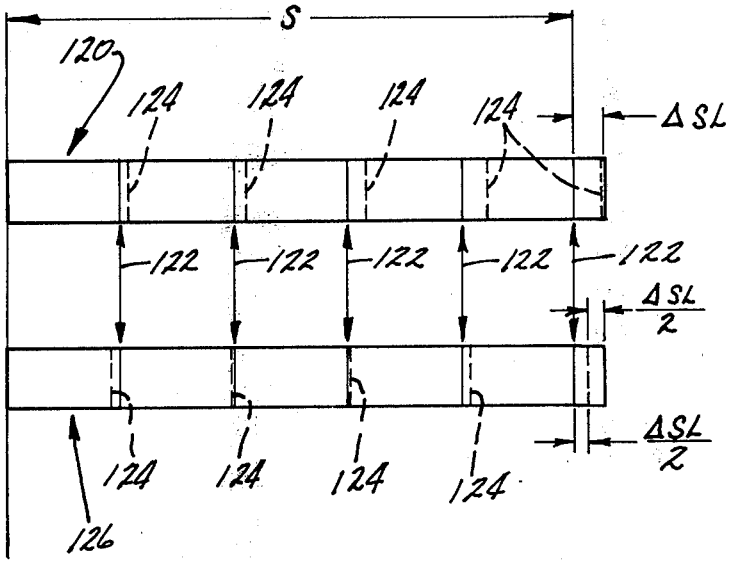
S
120
124
124
124
124
ΔSL
122
122
122
122
122
ΔSL/2
ΔSL/2
124
124
124
124
126

CTR
U/D
C
LOAD
CLR REGISTER
SHIFT REGISTER
RUNNING AVERAGE
ONE SHOT
CAMERA
TACH
Q
R
S
D
CK
÷

COMPOSITE CAN REGISTRATION

BACKGROUND OF THE INVENTION

In the production of composite cans, layers of the composite can material are spirally wound onto a mandrel to produce a tube. The tube moves down the mandrel and is servered into lengths, called sticks, which are equal in length to a predetermined multiple of the length of an indivudual composite can. The sticks are then sent to a recutter, where they are cut into the final composite can length. Since a printed label having a repeating pattern forms the outside layer of the tube, the point at which the tube is severed to form sticks is critical. If the tube is not cut correctly (i.e. if cutting does not occur at the border between two adjacent patterns), the patterns will be improperly aligned when the stick is recut into can length. This error in the cutting of sticks is referred to as registration error. The problem, then, is to control the cutting of the tube so that the pattern is properly aligned on the stick which is formed, i.e. so that accurate registry is obtained.

In prior control systems, the cutting knives have been carried on a reciprocating carriage whose speed during the cutting cycle has been synchronized with the forward speed of the tube as it moves down the mandrel. Registration has been controlled by maintaining the long term phase relationship between the carriage and the occurrance of equally spaced marks, called eyemarks, which are printed along a blank strip on the edge of the label (e.g., the knives may engage after ten eyemarks have passed a particular reference point). In this type of system the marks are read prior to the winding of the label onto the mandrel. The principal disadvantage of this type of control system is that it takes into account only one factor which affects the point at which cutting should occur for proper registration, i.e. the winding progress of the label (represented by the passage of eyemarks past a reference point). Several additional factors are important, however. One such factor is the variation in the point at which the label is wound onto the mandrel, called the wrap point. Due to a variety of forces, the wrap point typically moves up and down the longitudinal axis of the mandrel a few tenths of an inch. A second such factor is short term fluctuation in the speed of wrapping between the points at which the eyemarks are sensed. Another factor is variation in the "pitch", i.e. the length of tube which is to be cut off to form a correctly registered stick. There are two reasons for this variation in pitch. The first is that the label may actually stretch during the winding process. Secondly, variations in the relative angle at which the label is wrapped onto the mandrel also cause changes in pitch. The combination of the variable factors of wrap point, label stretch, and pitch may thus cause significant registration errors when utilizing the carriage-eyemark phase control system. The present invention is intended to be utilized to reduce registration error by taking into account these additional factors.

Other methods, in addition to the carriage-eyemark phase control system, have been developed for the purpose of eliminating registration errors. In U.S. Pat. Nos. 3,133,483 and 3,150,574 the cutter blade is aligned with a distinguishing feature, such as a magnetic strip, which is located at the point on the tube where cutting is to take place. Once the cutter is aligned with the feature, it engages the tube and makes the cut. In another system, described in U.S. Pat. No. 3,150,575, an initial adjustment is made to correct the pitch by adjusting the angle at which the label is wrapped onto the mandrel. The cutting is then done a fixed distance from the end of the tube by aligning a light source (which is positioned one stick length from the cutter) with the end of the tube.

One object of the present invention is to achieve proper registration of sticks without requiring either a distinguishing feature on the outside of the tube or adjustment of the pitch of the tube.

It is a further object of the invention to automatically reject sticks which are cut out of registry.

Further objects of the invention will become apparent upon consideration of the accompanying specification and drawings.

SUMMARY OF THE INVENTION

The present invention provides an improved method and apparatus for obtaining accurate registry on spirally wound tubes. A conventional control system maintains the long term phase relationship between the motion of a reciprocating carriage, which carries cutting means, and reference marks appearing on a label which is being wound. In order to make rapid changes in the position of the cutting means, a relatively lightweight moveable sled is mounted on the carriage, and the cutting means are in turn mounted on the sled. An electronic control circuit determines residual registration errors which have not been corrected for the basic control system. The error is combined with the present position of the sled on the carriage in order to generate a position change signal which is sent to a servomotor which drives the sled. Any registration error that remains when cutting occurs is compared to preset limits. If the limits are exceeded, the section of tube which was cut off is automatically rejected.

BRIEF DESCRIPTION OF THE DRAWINGS

FIG. 3 is geometrical representation of the actual and desired positions of the mandrel and label of FIGS. 1 and 2 and the relationships therebetween;

FIG. 4 is a schematic of the control system according to the present invention;

DETAILED DESCRIPTION

Figure 1:
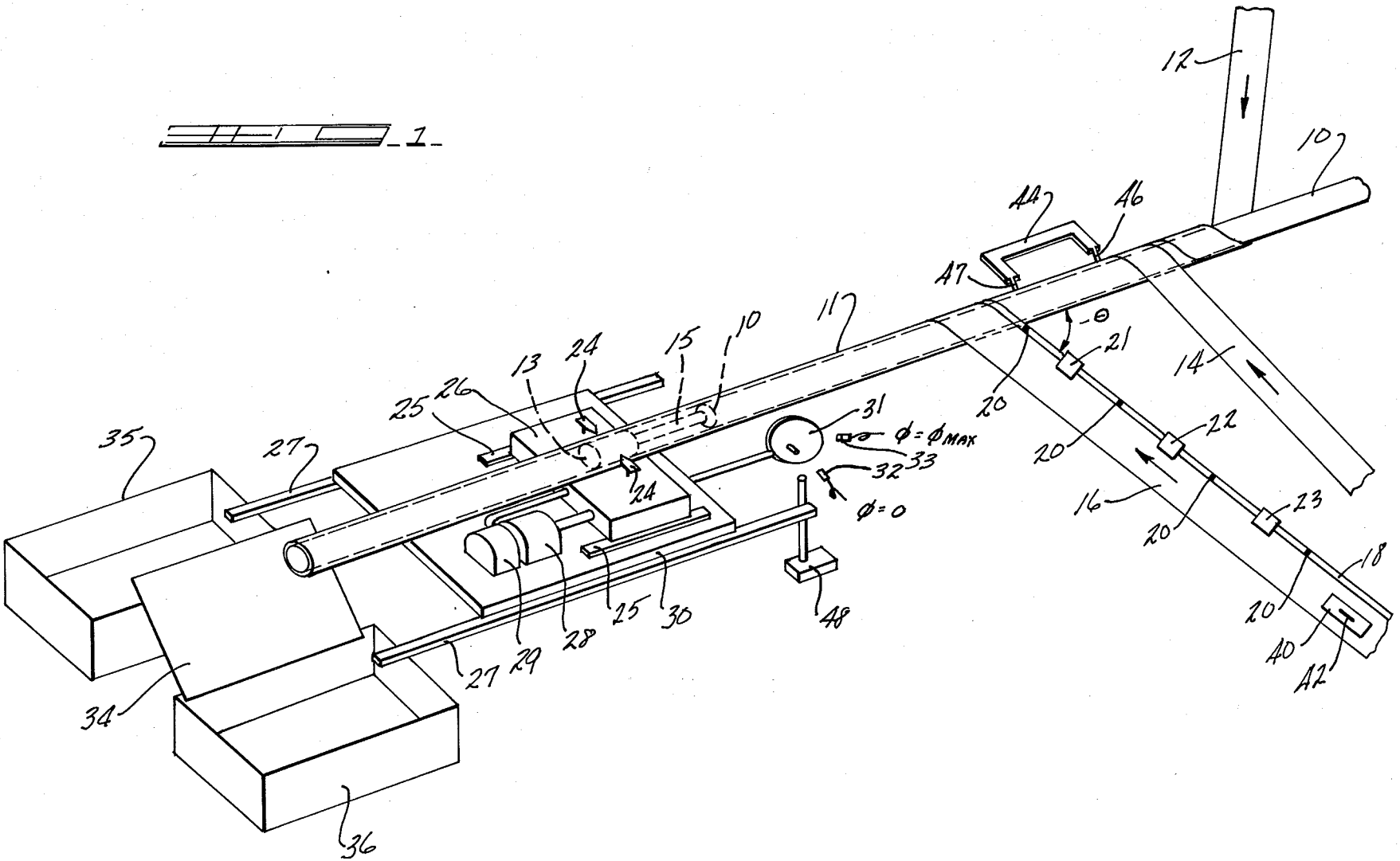
FIG. 1 is a perspective view of a composite can forming apparatus and control according to the present invention.

Referring to FIG. 1, a composite tube 11 is formed by winding an inner liner 12, either one or two layers of structural ply 14, and a printed label 16 having a repeating pattern (not shown) around a mandrel 10. The tube 11 is propelled down the mandrel 10 by means of a winding belt (not shown). As the tube 11 moves down the mandrel 10 sections called sticks, which are equal in length to some integral multiple of the one length of an individual composite can are cut off from the end of the tube 11. Ideally, cutting is done in register with respect to the pattern on the label 16. The sticks are then sent to a recutter (not shown), where they are cut into individual can lengths. The cutting of the tube 11 is done by two knives 24, which are intermittently forced against a reciprocating anvil 13. The anvil 13 is connected to a rod 15 which slides in the center of the mandrel 10. The knives 24 remain engaged against the anvil 13 for a period of time which is sufficient to allow the entire circumference of the tube 11 to be cut (i.e. allow enough rotation of the tube 11 so that the knives 24 engage every point on the circumference of the tube 11). The knives 24 are mounted on a relatively lightweight moveable sled 26 which is driven by a servomotor 28, which in the preferred embodiment is a stepping motor.

A conventional position transducer 29 is connected to the sled 26, and generates a signal which is proportional to the location of the sled 26 with respect to a reciprocating carriage 30. The sled 26 is mounted on the carriage 30, which is driven by a rotating cam 31. The anvil 13 moves in synchronization with the carriage 30. A pair of sensors 32 and 33, which are conventional optical sensors, generate signals corresponding to the angular position of the cam 31 of $\phi=0$ and $\phi=\phi_{max}$, respectively. Both the sled 26 and the carriage 30 move along a line parallel to the longitudinal axis of the tube 11. The sled 26 and carriage 30 are supported by pairs of rails 25 and 27, respectively. The forward motion of the carriage 30 and the anvil 13 is synchronized with that of the tube 11, so that while the knives 24 are engaged with the tube 11, the carriage 30, the tube 11, and the anvil 13 are moving in the same direction and at the same speed, so as to ensure a clean cut. The basic control system, which is well known in the art, maintains the long term phase relationship between the carriage 30 and the label 16. Prior to engagement of the knives 24, positional adjustments are made by the sled 26 so that cutting is accomplished at precisely the proper point. The exact operation of the sled 26 will be discussed subsequently.

In certain instances, there is not enough time to move the sled 26 to make the necessary adjustments in the position of the knives 24 to allow for proper registration. Whenever registration is inaccurate for this or other reasons, a moveable ramp 34 is automatically tilted so that the stick which was improperly registered rolls into a reject bin 35 after being cut. The ramp 34 is normally tilted so that sticks which have been properly registered roll into bin 36, from which they are sent to be recut into can length.

Referring further to FIG. 1, an unprinted strip 18, which is usually white, is located along one edge of the printed label 16. The strip 18 includes a plurality of reference marks 20, called eyemarks, which are located at evenly spaced intervals along the strip 18. Three cameras 21, 22, and 23 are located above the strip 18 and are utilized to detect the position of the edge of the label 16 and the passage of eyemarks 20. The specific function of each of the cameras 21, 22, and 23 will be discussed subsequently. An incremental tachometer 40, driven by a wheel 42 riding on the label 16, generates an output representing the amount of travel of the label 16. A mandrel sensor 44 includes two feelers 46 and 47 which contact the tube 11, and is utilized in conjunction with cameras 21 and 23 in the determination of the wrap angle between the mandrel 10 and the label 16. A carriage advance sensor 48 generates a predetermined number of pulses for each revolution of the carriage cam 31.

In general terms, the operation of the system may be described as follows. The basic control system maintains the long term phase error between the carriage 30 and the eyemarks 20 on the label 16 at zero. This is done by synchronizing pulses from the carriage advance sensor 48 with the sensing of the passage of eyemarks 20. In the last few degrees of the carriage cam cycle before the knives 24 engage, however, the residual registration error is frequently too large to be eliminated by manipulating the entire carriage 30 in the time remaining before the cut begins. The servomotor 28 and sled 26 are utilized to reposition the knives 24 quickly so as to correct for this residual registration error. The instantaneous position of the knives 24 with respect to the carriage 30 is determined from the positional signals received from the position transducer 29. Signals from the cameras 21, 22 and 23, the mandrel angle sensor 44, the label advance tachometer 40, the carriage advance encoder 48, and the optical sensors 32 and 33 are analyzed in order to determine the point along the tube 11 where cutting should occur. The position of this point is then combined with the present position of the sled 26 to obtain a position-change command which is sent to the servomotor 28. Beginning shortly before the time the knives 24 are to engage, the servomotor 28 executes this command and any changes in its value that occur before engagement. When the knives 24 have engaged, the servomotor 28 is stopped, whether or not it has fully executed the command. The residual error, if any, is then compared to present limits, and if it is found to be too large, the stick that was cut off is automatically rejected when it arrives at the moveable ramp 32.

In order to determine the contribution to error by the basic control system, which may be referred to as short term phase error, it is necessary to determine the phase discrepancy between the motion of the carriage 30 and the passage of eyemarks 20. If $\phi_{tgt}$ is defined as the angle of the carriage cam 31 at which a reference eyemark 20 would be seen if there were no phase error, and $\phi_{em}$ is defined as the angle of the carriage cam 31 at which the reference eyemark 20 is actually seen, the error contribution of the phase control system may be expressed as $$(\phi_{em}-\phi_{tgt})(dc/d\phi),$$

where $dc/d\phi$ represents inches of carriage motion per carriage cam angle change. Since $dc/d\phi$ is a constant during the cutting cycle (i.e. when the carriage is moving forward) the expression may be rewritten as $$(\phi_{em}-\phi_{tgt})\ k_1,$$

Figure 2:
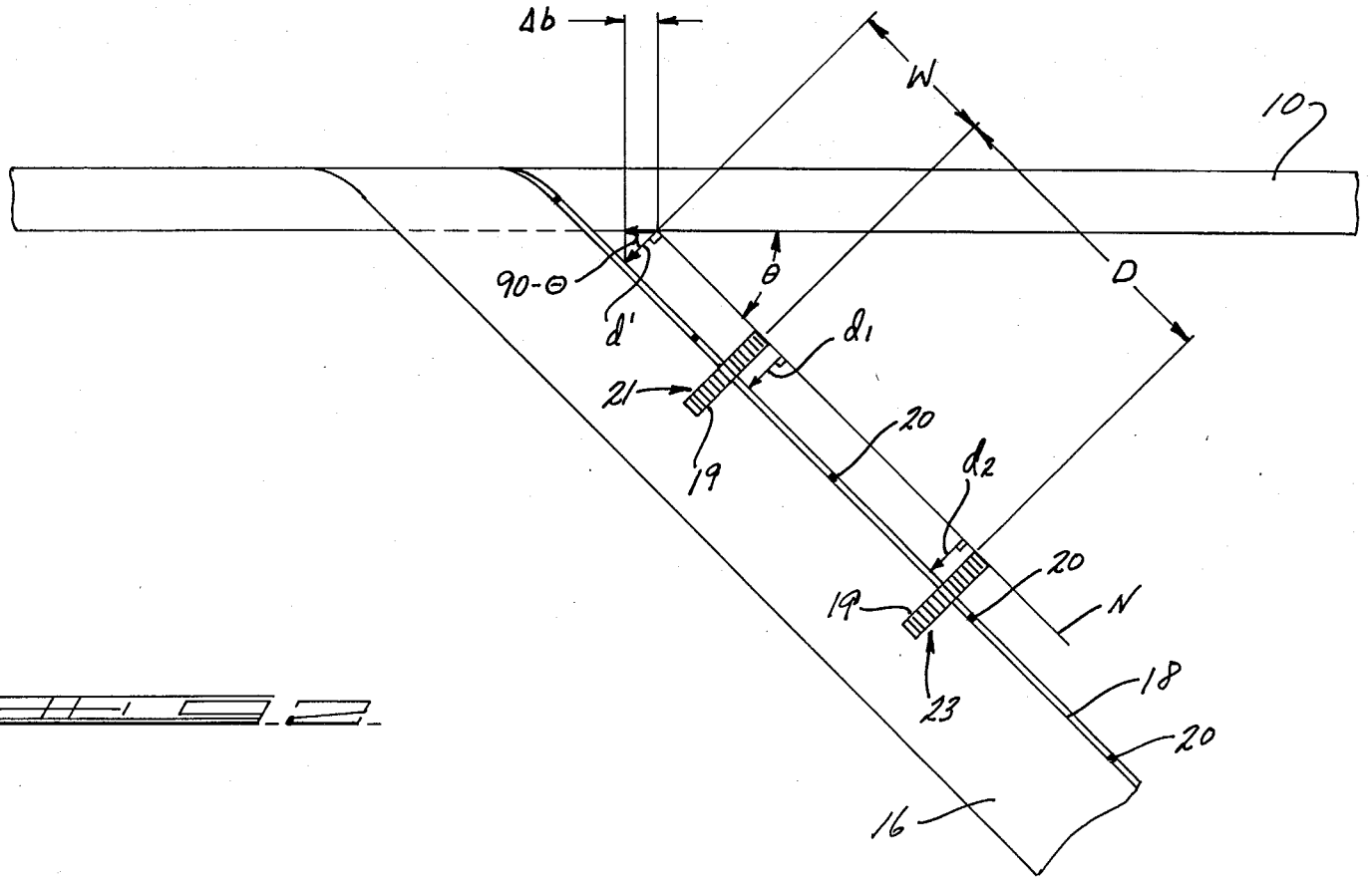
FIG. 2 is a plan view of the mandrel and label of FIG. 1 showing the geometric relationships therebetween.

The second factor to be taken into account in determining error is the wrap point, i.e. the point along the axis of the mandrel 10 where the label 16 wraps onto the mandrel 10. Referring to FIG. 2, the edge of the label 16 is measured by cameras 21 and 23, both of which include a linear array of photodiodes 24. The cameras 21 and 23 generate digital output signals $d_1$ and $d_2$ respectively, representing the distance at each camera between the edge of the label 16 from its nominal position, denoted by a line N. (These distances are measured along lines perpendicular to line N). The nominal angle of wrap (i.e. the angle between line N and the nominal position of the mandrel 10) is denoted by $\theta$, and may be considered a constant for the purposes of determining the wrap point. If the distance between the cameras 21 and 23 is designated as D, and the distance from camera 21 to the point where the label wraps onto the mandrel is designated as W, it may be shown that the distance d', which is the distance between the line N where it intersects the mandrel 10 and the edge of the label 16 (measured along a line normal to line N) follows the relationship:

$$d' = d_1(1+(W/D)-(W/D)d_2$$

The distance $\Delta b$, which is the wrap point error, follows the relationship:

$$\Delta b = d' \sin\theta$$

$$\Delta b = [d_1(1+(W/D)-(W/D)d_2] \sin\theta$$

It will be noted that W, D, and sin $\theta$ are all constants. The wrap point error $\Delta b$ may thus be rewritten as:

$$\Delta b = k_2 d_1 - k_3 d_2.$$

Referring now to FIG. 3, the wrap angle error contribution $\Delta T$ may be determined. For this factor, the $d_1$ and $d_2$ signals generated by the cameras 21 and 23, to obtain $d_1$ and $d_2$ (the same signals as are utilized for wrap point error), and the output of mandrel sensor 44 are utilized. The feelers 46 and 47 of the mandrel sensor 44 generate displacement signals $m_1$ and $m_2$ representing the distance between the nominal mandrel position, shown by line a R and the actual mandrel position (measured perpendicular to line R). The two feelers 46 and 47 are spaced a distance M apart. Initially, it may be shown that the error $\Delta T_d$, which is error due to label angle changes, follows the relationship:

$$\frac{d_1 - d_2}{D} = \frac{\frac{\Delta Td}{\sin\theta}}{L} = \frac{\frac{\Delta Td}{\sin\theta}}{\frac{T}{\cos\theta}} = \frac{\Delta Td}{T\tan\theta},$$

where T is equal to the distance from the nominal wrap point to the nominal cut point and L is the distance along the hypotenuse of a right triangle formed by lines N and R and having one side defined by the distance T. Therefore:

$$\Delta T_d = \frac{(d_1 - d_2)\, T\tan\theta}{D}$$

Similarly, with respect to the mandrel angle error $T_m$:

$$\Delta T_m = \frac{(m_1 - m_2)\, T\tan\theta}{M}$$

Combining these two equations to obtain T for the combination of mandrel angle and label angle, we have $$T\left[\frac{d_1 - d_2}{D} + \frac{m_1 - m_2}{M}\right] T\tan\theta$$

Since D, M, and T tan $\theta$ are constants, $\Delta T$ may be expressed as $$\Delta T = k_4(d_1 - d_2) - k_5(m_1 - m_2)$$

By taking a running average of the value of T with respect to the length of tube between the nominal wrap point and nominal cut point as a tube is wound, the error due to angle of wrap variations for each stick may thus be found.

Since the basic phase relationship is mewasured with respect to the passage of a particular reference eyemark 20, another possible source of error is short term winding speed fluctuations which occur after the sensing of the passage of the reference eyemark 20 but before engagement of the knives 24. This error may be referred to as label-carriage advance or instantaneous error. The continuous progress of the label 16 is monitored by the label advance tachometer 40. The tachometer 40 generates a predetermined number of pulses per revolution of the measuring wheel 42. By comparing the progress of the label 16 with that of the carriage 30 after the reference eyemark 20 has been sensed, any label-carriage advance error which occurs can be determined. This error may be defined as:

$$(\Delta\phi \frac{dc}{d\phi} - L\cos\theta)$$

where $\Delta\phi$ is the change in the carriage cam angle from the time an eyemark 20 is seen, $dc/d\phi$ is the amount of carriage 30 motion per angular change of the carriage cam 31, L is the measured amount of label 16 travel from the time the reference eyemark 20 is seen, and $\theta$ is the nominal angle of wrap. The first term represents progress of the carriage 30, while the second term represents progress of the label 16 (converted to stick length progress).

A final possible source of error is variations in the spacing between patterns (which include eyemarks 20), caused either by stretching of the label 16 during winding or by misprinting of the patterns. Cameras 21 and 22 are located a distance from each other which is equal to the nominal eyemark spacing. Any variation from this nominal distance may be determined by measuring the amount of label 16 travel between the sensing of eyemarks 20. If there is no error, cameras 21 and 22 will both see an eyemark 20 at the same time. If there is an error, the amount of label 16 travel between the sensing of eyemarks 20 is multiplied by cosine $\theta$ in order to determine its effect on stick length. As was the case with the wrap angle factor, a running average of the value of the intereyemark distance error is maintained over the length of tube between the nominal wrap point and nominal cut point in order to determine its total contribution to registration error.

The sum of the above determined error functions is equal to the total error with respect to the nominal cutting position of the knives 24, i.e. it represents the distance between the nominal cutting point and the point where cutting should occur. Since the actual position of the sled 26 may not correspond to the nominal cutting point, it must be taken into account in the determination of the actual position change command which is to be sent to the servomotor 28. Therefore, the actual position change command signal is equal to the difference between the error with respect to the nominal cut point and the position of the sled with respect to the nominal cut point. A block diagram of the control system is shown in FIG. 4. A circuit 50 for determining the short term phase relation error receives signals from the carriage advance sensor 48 and one shots 52, 54, and 56, which are triggered by sensors 32 and 33 and camera 21, respectively. The label-carriage advance error is determined by a circuit 58, which receives inputs from the carriage advance sensor 48, the one shot 56, and the label advance tachometer 40. Two digital-to-analog converters 60 and 62, driven by signals from cameras 21 and 23, respectively, generate input signals to circuit 64, which is utilized to determine wrap point registration error. (Camera 21 is utilized both for eyemark 20 sensing and label 16 edge sensing). An eyemark spacing registration error determination circuit 66 receives inputs from the one shot 56, the label advance tachometer 40, and a one shot 68 which is triggered by a signal from the camera 22. A circuit 70 determines wrap angle error, and receives inputs from the digital-to-analog converters 60 and 62, and the mandrel sensors 46 and 47. The error functions generated by circuits 50,58,64, 66 and 60 are summed through scaling resistors 72–76, respectively, by an op-amp summer 78. The scaling resistors 72–76 ensure that the output of each error circuit will be the same per inch of determined registration error (e.g. they take into account the values of different circuit constants).

A sample and hold device 80, which samples the signal from the sled position transducer 29, also provides an input signal to the summer 78 (through a scaling resistor 82). The sampling of the sample and hold device 80 is controlled by a signal from the phase rotation circuit 50 which corresponds to the sensing of the reference eyemark 20, marking the beginning of a correction cycle. This same control signal from circuit 50 is sent to an AND gate 84. A signal from the AND gate 84 enables the servomotor 28 to make corrections. The AND gate 84 is turned off, thus stopping the servomotor 28, when it receives a high signal from a flip flop 86. The flip flop 86 is set at an input S by a signal generated when the knives 24 engage (signalled by the closing of a switch 87) and is reset at an input R by the one shot 52 (i.e. when $\phi=0$). The angle $\phi=0$ is such that the knives 24 have disengaged before $\phi=0$. The servomotor 28 thus is able to make corrections from the time the reference eyemark 20 is sensed until the time the knives 24 engage.

Figure 5:
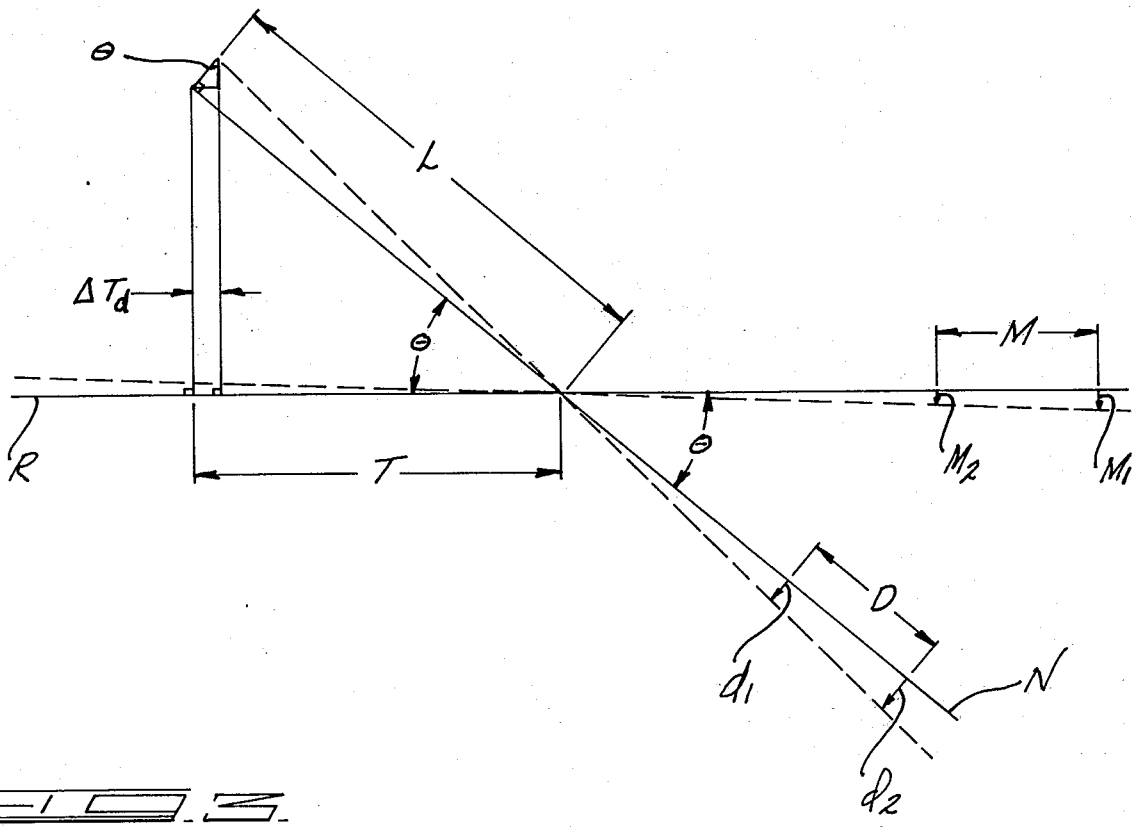
FIG. 5 is a schematical representation of the recutting of composite can sticks according to the present invention.

Generally, the output E of the summer 78 may be regarded as the correction or position change signal which is to be applied to the servomotor 28. However, since the stick which is cut is to be sent to a recutter to be cut into can length, proper registration of the stick (i.e. cutting according to the signal from the summer 78) may not always be desired. This is due to the fact that properly registered sticks may be of different lengths, due to wrap angle and eyemark spacing variations. However, the sticks are always recut into the same individual can length. A stick which has been properly registered, therefore, may be recut improperly. Referring to FIG. 5, a formed stick 120 is shown in position to be recut into can length. The length of the stick 120 exceeds the desired stick length S by a distance ΔSL. Recutting is always done for a fixed stick length and is done at fixed distances from one end of a stick, as shown by arrows 122. Dashed lines 124 represent the border between patterns on a stick. It is apparent that near the right end of the stick 120, the distance between the border 124 and the actual cutting point becomes great, resulting in unacceptable cans. This problem may be somewhat alleviated, however, by intentionally causing each stick to be misregistered by a distance equal to ΔSL/2, as shown by a stick 126. The distance between the borders 124 is still the same, of course. The remaining ΔSL/2 will appear on the succeeding stick which is severed, so each stick will still have a length of S+ΔSL. (This assumes that ΔSL is the same for every stick. Although this in not generally true, the principal is that each stick will contain half of the stick length registration error of both the stick being cut and the preceding stick). It can be seen that the error in stick length (causing cutting to occur at some place other than a border 124) is in effect distributed over the length of the stick 126. The effect of the misregistration is to shift the points of recutting to the left by a distance equal to ΔSL/2, which causes a stick to be centered with respect to the recutter. The greatest distance between the actual cutting point and a label border 124 with stick 126 is thus one half of the greatest distance between the actual cutting point and a label border 124 on stick 120. This reduced recutting error may very well be concealed when lids are placed on the cans, and it assures that the elevation of every label will be the same (e.g. printing will always be at the same height).

The above discussion demonstrates that, in cases where stick length error may be great, it is advantageous to intentionally misregister a stick by one half of ΔSL when actually cutting a stick. In the diagram of FIG. 4, this is accomplished by feeding the error signals which contribute to stick length error, i.e. from circuits 66 and 70, through an op-amp summer 88, and then subtracting the output of summer 88 from the output of summer 78. This is done with another op-amp summer 90. The outputs of circuits 66 and 70 are fed to summer 88 through scaling resistors 92 and 93, respectively. The output of summer 88 is inverted by an inverter 94 and fed to summer 90 through a scaling resistor 96. The output of the summer 78 is fed to summer 90 through a scaling resistor 98. The values of resistors 96 and 98 are chosen so that the full value of the output of summer 78 is taken into account while only one half the value of the output of summer 88 is taken into account. The output of the summer 90 thus corresponds to E−ΔSL/2, and may be used as the position change command. By opening a switch 100, connected between the output of the inverter 94 and the resistor 96, only the value E will be represented at the output of the summer 90.

Since the servomotor 28 is stopped when the knives 24 engage whether or not the position change command is fully executed, it is necessary to determine whether or not the cut which was actually made is acceptable. Completely accurate registration is not required. In order to check the registration, the present value S generated by the position transducer 29 is inverted by an inverter 102 and passed through a scaling resistor 104 to an op-amp summer 106. The value of the position transducer signal $S_{em}$ at the beginning of a connection cycle is fed to the summer 106 through a scaling resistor 108. The error value E is fed to the summer 106 through a scaling resistor 110. The output of the summer 106 represents the difference between the amount of knife change and the magnitude of the error. This value is compared with preset limits by a comparator 116. If the limits are exceeded, a reject machanism 118 automatically causes the stick which was cut to be rejected (by tilting the ramp 34). The reject machanism 118 operates only after the servomotor has been stopped, and is controlled by a signal from the AND gate 84.

Figure 6:
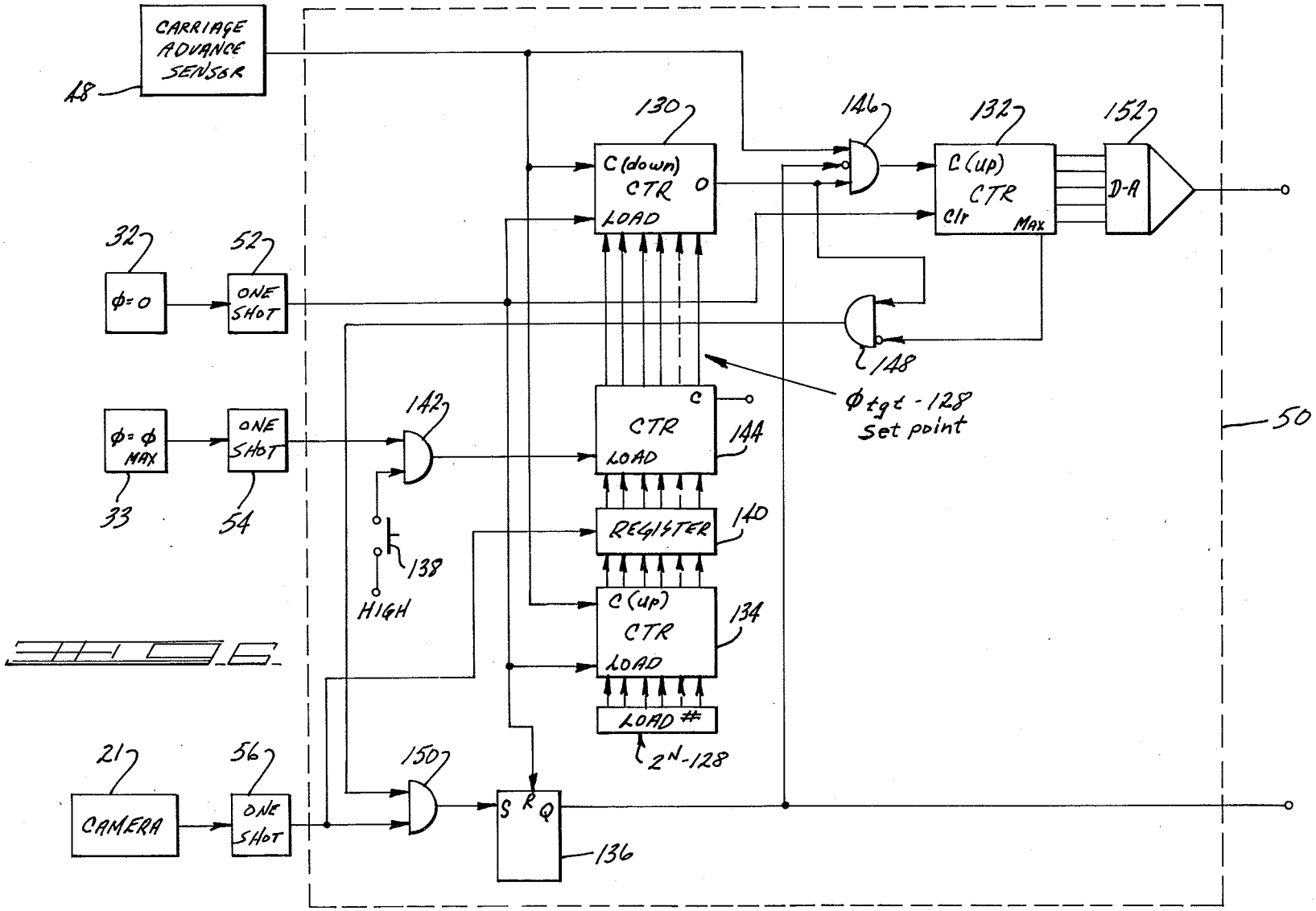
FIG. 6 is a schematic of the short term phase relation error circuit of FIG. 4.

Referring now to FIG. 6, the short term phase error circuit 50 will be described. Initially, as the system is being set up a normally open switch 138 is closed to connect a power supply (not shown) to an input of an AND gate 142, thus enabling the AND gate 142. Each pulse from the one shot 52, generated when the position of the carriage cam 31 corresponds to $\phi=0$, cause counters 130, 132 and 134 to load, and flip flop 136 to reset. Counter 134 is loaded to a number equal to $2^N-128$, where N is equal to the number of bits of the counter 134 (i.e. the capacity of the counter 134 is $2^N$). Each pulse from the carriage advance sensor 48 causes counter 134 to count up one. Whenever an eyemark 20 is sensed by camera 21, one shot 56 causes the number in counter 134 to be shifted to a register 140. When the carriage cam angle is equal to $\phi_{max}$, which is an angle chosen so that there is just enough time to make a correction before the knives 24 engage, a pulse from one shot 54 causes an AND gate 142 to switch on, which in turn causes the number in register 140 to be loaded into a counter 144. The number stored in counter 144 after the last eyemark 20 before $\phi=\phi_{max}$ appeared. (This is the reference eyemark 20, the sensing of which initiates a correction cycle). If the position of carriage cam 31 when the reference eyemark 20 is sensed is defined as $\phi_{tgt}$, it will be appreciated that the number stored in counter 144 is equal to $\phi_{tgt}-128$. $\phi_{tgt}$ thus is the target angle, i.e. the position of the carriage cam 31 at which the reference eyemark 20 of the next stick would be seen if there were no phase error. The number $\phi_{tgt}-128$ thus becomes the permanent set point, and switch 138 is then opened.

The next pulse from one shot 52 (i.e. at $\phi=0$) will cause the number $\phi_{tgt}-128$ to be loaded into counter 130, clear counter 132, reload counter 134 and reset flip flop 136. Counter 130 will then count down from $\phi_{tgt}-128$ in response to each pulse from the carriage advance encoder 48. When the counter 130 reaches zero, it sends a signal to an AND gage 146 which, absent a signal from the flip flop 136, allows counter 132 to begin counting pulses from the carriage advance sensor 48. Counter 132 thus starts counting one hundred twenty-eight counts before $\phi_{tgt}$, i.e. one hundred twenty-eight counts before the reference eyemark 20 is expected. Counter 132 can make two hundred fifty-six total counts (i.e. it is an eight-bit counter), with the one hundred twenty-eighth count corresponding to $\phi_{tgt}$. Counter 132 thus in effect is looking at a two hundred fifty-six count window centered about $\phi_{tgt}$. When the counter 130 reaches zero, a signal from it causes AND gate 148 to go high, thus enabling an AND gate 150 to set flip flop 136 when the next eyemark 20 appears (i.e. the next signal from one shot 56). When this occurs, the high Q output of flip flop 136, sent to an inverting input of AND gate 146, causes the AND gate 146 to close, which in turn causes counter 132 to stop counting. If the counter 132 counts out before the reference eyemark 20 is seen (i.e. if the reference eyemark 20 is more than one hundred and twenty-eight counts away from $\phi_{tgt}$), a signal generated by counter 132 sent to an inverting input of AND gate 148 closes the AND gate 148, and no error can be determined for that cycle.

The number stored in counter 132 is converted into an analog voltage whose value is from $-V$ to $+V$ by a digital-to-analog converter 152. The output voltage of the converter 152 thus will be $-V$ if no counts were made, zero if one hundred twenty-eight counts were made, and $+V$ if two hundred fifty-six counts were made. It is to be appreciated that the number of counts to either side of one hundred twenty-eight represents the difference between $\phi_{tgt}$ and the angle at which the reference eyemark 20 was actually seen ($\phi_{em}$). The output of the digital-to-analog converter 152 thus corresponds to $\phi_{em}-\phi_{tgt}$. The circuit resets at $\phi=0$ (with $\phi_{tgt}$ remaining the same). During operation of the system, fine adjustments in the value of $\phi_{tgt}$ may be made by causing counter 144 to be counted either up or down. The output of flip flop 136 signifies the arrival of the reference eyemark 20 (i.e. the first eyemark 20 seen after $\phi=\phi_{tgt}-128$). This is the reference eyemark discussed in connection with FIG. 4. It is thus the output of flip flop 136 which is sent to the sample and hold device 80 and AND gate 84 of FIG. 4.

Figure 7:
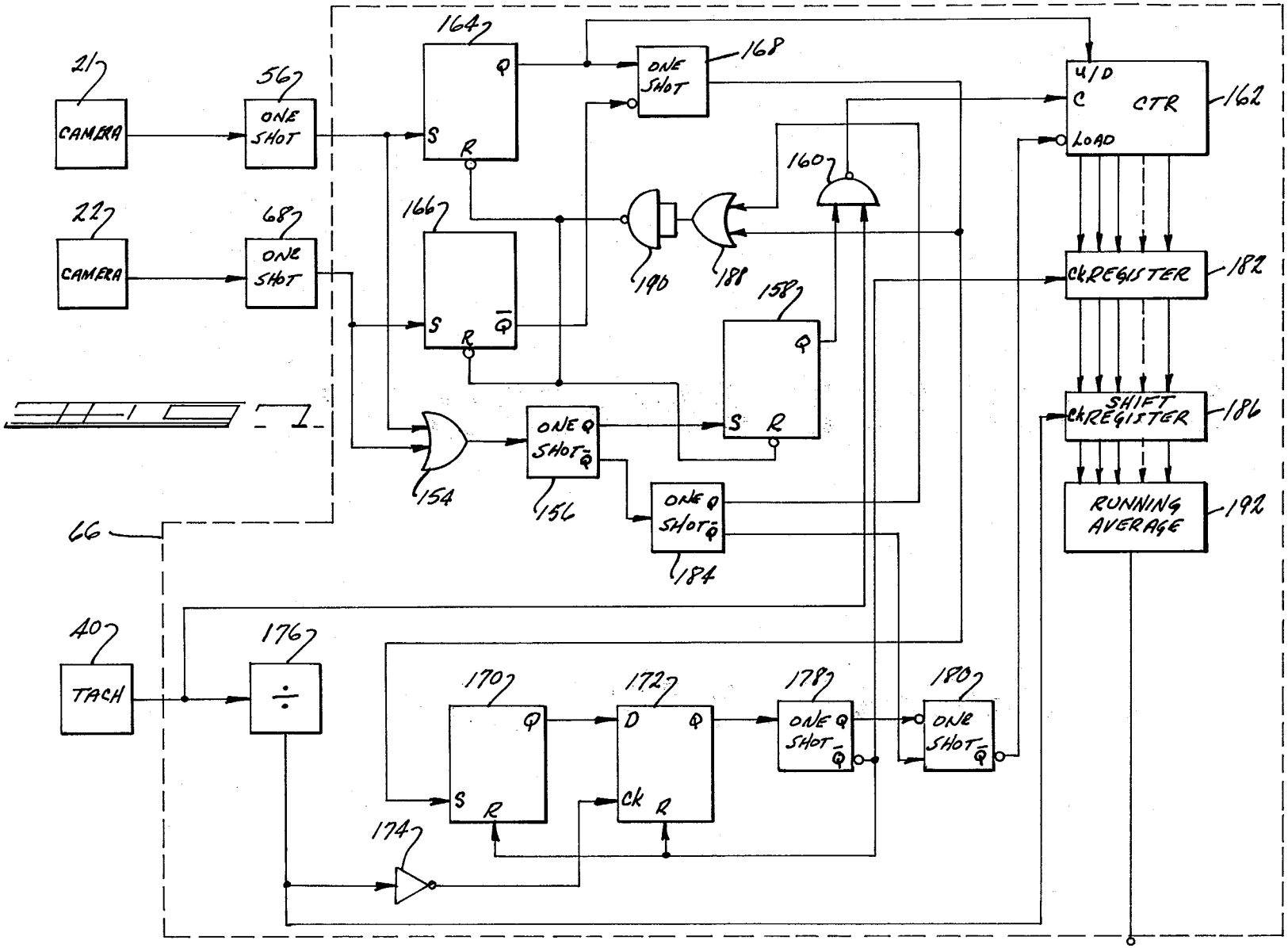
FIG. 7 is a schematic of the eyemark spacing registration error circuit of FIG. 4.

Referring now to FIG. 7, the eyemark spacing determination circuit 66 is shown. The purpose of this circuit is to determine the amount of label travel between the time adjacent eyemarks 20 are sensed by cameras 21 and 22. The order in which the eyemarks 20 are sensed, i.e. whether camera 21 or camera 22 sees an eyemark 20 first, determines whether a stick would be longer or shorter than its nominal value. Upon sensing of the first eyemark 20, a pluse from either one shot 56 or 68 (depending upon whether camera 21 or 22, respectively, sees an eyemark 20 first) causes an OR gate 154 to go high and trigger a one shot 156. This in turn sets a flip flop 158, which enables a NAND gate 160 and enables pulses to pass from the label advance tachometer 40 to a counter 162. The counter 162 is preloaded to one hundred and twenty-eight and will count either up or down depending upon which camera 21 or 22 sees an eyemark 20 first. The direction of counting is controlled by a signal from flip flop 164, which is set by the one shot 56 when camera 21 sees an eyemark 20. The direction of counting determines whether stick length is greater or less due to eyemark spacing variation.

When the first eyemark 20 is seen by one of the cameras 21 or 22, either flip flop 164 or 166 is set, respectively, and one shot 168 is enabled. When the remaining camera 21 and 22 sees its corresponding eyemark 20, one shot 168 is triggered. Thus, one shot 168 is triggered after both adjacent eyemarks 20 have been seen by their respective cameras 21 and 22. The signal from the one shot 168 sets a flip flop 170. The Q output of flip flop 170 is passed to the data input of a flip flop 172. Flip flop 172 is then set by a pulse from an inverter 174. The inverter 174 inverts pulses from a frequency divider 176, which receives pulses from the label advance tachometer 40. In the preferred embodiment, the frequency divider 176 provides sixty-four purses per the length of label between camera 21 and the wrap point. Flip flop 172 triggers a one shot 178 which in turn triggers a one shot 180, resets flip flops 170 and 172, and causes a register 182 to be loaded with the number in the counter 162. The one shot 180 is enabled by a pulse from a one shot 184, which was triggered by one shot 156, (i.e. when the first eyemark 20 was seen). A pulse from one shot 180 causes counter 162 to load to one hundred and twenty-eight. Pulses from the frequency divider 176 also cause a shift register 186 to load the number stored in register 182. Flip flops 164, 166 and 158 are reset through an OR gate 188 and a NAND gate 190 by pulses from one shots 168 or 184, i.e. after each eyemark 20 has been seen.

The operation of the above-described circuit is as follows. When either of the cameras 21 or 22 sees an eyemark 20, the counter 162 begins counting pulses from the label advance tachometer 40. The counter 162 is preloaded to one hundred and twenty-eight and the direction of counting depends upon which camera sees an eyemark 20 first. When the second camera sees an eyemark 20 counter 162 stops counting, the number in it is shifted into register 182 and counter 162 is then reloaded to one hundred and twenty-eight. The number in register 182 is loaded into shift register 186 every time a pulse from the frequency divider 176 is received. In the preferred embodiment, therefore, the shift register 186 is loaded sixty-four times over the label travel between camera 21 and the wrap point. The purpose of the shift register 186 is to provide a delay function, so that the final error output reflects the part of the lable which is actually on the mandrel between the nominal wrap point and nominal cut point. A running averager 192, which is a conventional running average circuit, provides at its output an average of the output of the shift register 186 over the length of tube from the nominal wrap point to the nominal cut point. It is to be appreciated that the number of readings taken over this distance is not critical. Nor for that matter is the load number of counter 162. From the foregoing, it is clear that the number of counts counter 162 makes away from its load number reflects the amount of label travel between the sensing of adjacent eyemarks. The output of the averager 192 reflects the average of these distances over the length of tube from the nominal wrap point to the nominal cut point.

Figure 8:
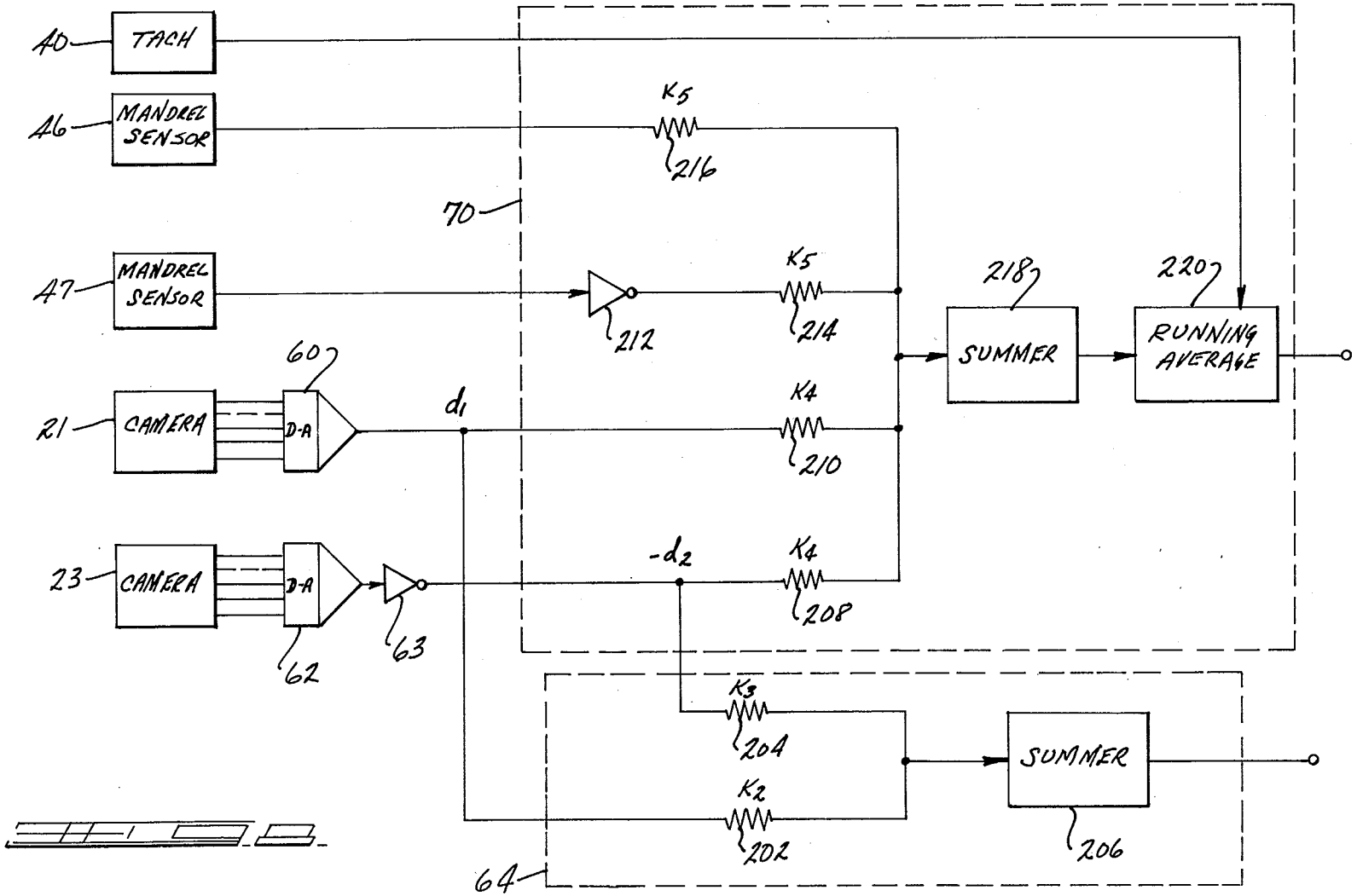
FIG. 8 is a schematic of the wrap point registration error circuit and the wrap angle registration error circuit of FIG. 4.

Referring now to FIG. 8, the circuit 64 for determining the wrap point error is shown. Initially, the digital outputs $d_1$ and $d_2$ of each of the cameras 21 and 23 is converted to an analog value by digital-to-analog converters 60 and 62, respectively. The output of converter 62 is inverted by the inverter 63. The outputs of converter 60 and the inverter 63 are passed through resistors 202 and 204, respectively, and summed by an op-amp summer 206. The values of the resistors 202 and 204 are chosen to reflect constants $k_2$ and $k_3$, respectively. The output of the summer 206 thus represents wrap point registration error $\Delta b$.

Referring further to FIG. 8, the wrap angle error determination circuit 70 also utilizes the outputs of the converter 60 and the inverter 63, which are passed through a pair of resistors 210 and 208, respectively, to an op-amp summer 218. Resistors 208 and 210 are chosen to reflect the value of the constant $k_4$. The signal from the feeler 47 of the mandrel sensor 44 (i.e. $m_2$) is inverted by an inverter 212 and passed through a resistor 214 to the summer 218. The signal from feeler 46 (i.e. $m_1$) is passed through a resistor 216 to the summer 218. Both of the resistors 214 and 216 are chosen to reflect the value of the constant $k_5$. The outputs of resistors 208, 210, 214 and 216 are added by the op-amp summer 218. A running average of the output of the summer 218 is taken by a running averager 220 which is identical to the running averager 192 of FIG. 7. The running averager 220 provides an output that reflects the average wrap angle error contribution over the distance between the nominal wrap point and nominal cut point, and its sampling is controlled by pulses from the label advance tachometer 40. The output of the running averager 220 thus represents wrap angle error.

Figure 9:
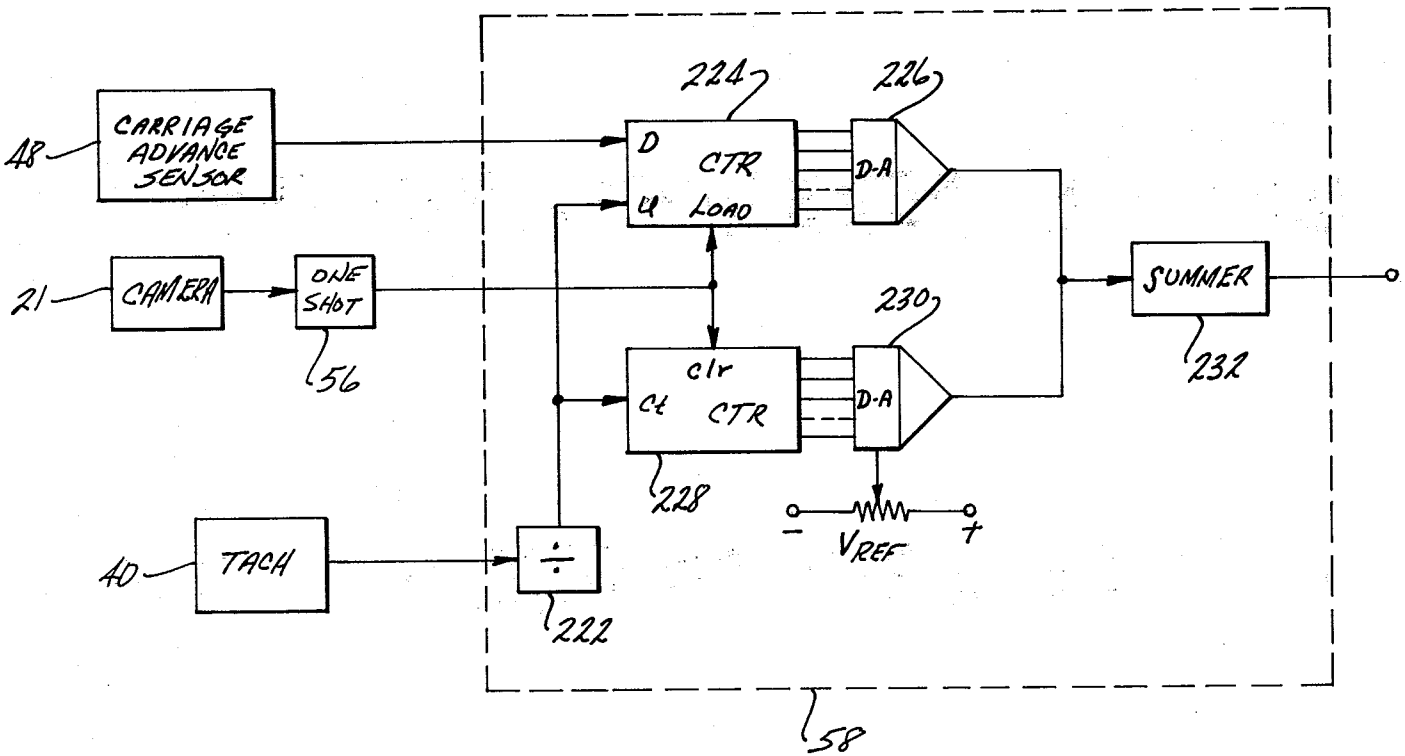
FIG. 9 is a schematic of the label-carriage advance error circuit of FIG. 4.

Referring now to FIG. 9, the circuit 58 for determining label-carriage advance error is shown. As previously discussed, this error is determined by comparing the progress of the label 16 with that of the carriage 30 after the sensing of the passage of the reference eyemark 20. Initially, a frequency divider 222, which is connected to the label advance tachometer 40, generates pulses which are equal in weight to those from the carriage advance sensor 48 for a particular length of label in a stick. In other words, each pulse from the frequency divider represents the winding of a certain portion of a stick length while each pulse from the carriage advance endoder 48 represents an equal amount of carriage 30 travel. A signal from one shot 56, corresponding to the sensing of an eyemark 20 by camera 21, causes a counter 224 to be loaded. Pulses from the carriage advance sensor 48 then cause the counter 224 to count down, while pulses from the frequency divider 222 cause the counter 224 to count up. Since pulses from the sensor 48 and the frequency divider 222 are equal in weight, the counter 224 will remain at the load number only if there is no label-carriage advance error. If there is some label-carriage advance error (i.e. the motion of the carriage 30 and label 16 are not synchronized) the pulses from the carriage advance sensor 48 and the frequency divider 222 will occur at a different rate, and the counter 224 will count away from the load number. For example, if at a particular time fifty pulses had been received from the carriage advance sensor 48 while only forty pulses had been received from the frequency divider 222, the counter 224 would be at a number ten below the load number. The number in the counter 224 is converted to a voltage from $-V_2$ to $+V_2$ by an digital-to-analog converter 226, with the load number corresponding to zero volts. The output of the digital-to-analog converter 226 thus is a function of the label-carriage advance error, since its value corresponds to the difference between the number of pulses received by the counter 224 from the carriage advance sensor 48 and the frequency divider 222.

Since the pulses from the frequency divider 222 are of equal weight to those from the carriage advance sensor 48 only for a particular length of label per stick, if is necessary to provide means to compensate for different values of label length per stick. Referring further to FIG. 9, a counter 228 is cleared when a pulse is received from one shot 56 at the same time counter 224 is loaded. The counter 228 then begins counting pulses from the frequency divider 222. The number in counter 228 is fed to an digital-to-analog converter 230. The analog output of the digital-to-analog converter 230 is equal to the product of the binary input from the counter 228 and a supply voltage $V_{ref}$. By varying the value of $V_{ref}$, the output of the digital-to-analog converter 230 may be sent to a particular value per count from the counter 228. The outputs of the digital-to-analog converters 226 and 230 are then added by an op-amp summer 232. Since the difference between the nominal and actual values of label length per stick is known, $V_{ref}$ may be computed so that the output of the digital-to-analog converter 230 provides compensation for the mismatch in the weighting of pulses from the frequency divider 222 and the carriage advance sensor 48. In other words, $V_{ref}$ is set so that a value is added or subtracted to the output of digital-to-analog converter 226 which exactly compensates for the contribution to the value of the output of the digital-to-analog converter 226 caused by the misweighting of the frequency divider 222 pulses. For example, if for proper synchronization two pulses from the frequency divider 222 should equal one pulse from the carriage advance sensor 48, and each pulse contributes one volt to the output of the digital-to-analog converter 226, $V_{ref}$ would be set so that one-half volt would be subtracted from the digital-to-analog converter 226 output for each pulse received from the frequency divider 222. The output of the summer 232 would thus increase one volt for every two pulses from the frequency divider 222 and decrease one volt for every one pulse from the carriage advance sensor 48, which is exactly what is desired.

Although discrete electrical components are utilized to generate the various registration error signals in the specific embodiment of the invention described herein, the scope of the invention is not intended to be limited by this description. In particular, each of the various registration error signals may be generated by means of suitable microprocessor systems. Accordingly, the scope of the invention is intended to be defined not by the foregoing description, but only by the appended claims.

What is claimed is:

1. In a method for producing spirally wound containers wherein a plurality of layers of material are spirally wound onto a mandrel to form a tube, the outside layer of said material being a label having a repeating pattern which includes a plurality of generally equally spaced apart reference marks located along its length, wherein sections of said tube are severed in register with said pattern by cutting means connected to a reciprocating carriage which moves parallel to the longitudinal axis of said tube, and wherein registration is controlled by maintaining the long term phase relationship between the motion of the carriage and the sensing of the passage of said reference marks past a reference point, an improved method wherein said cutting means are carried by a movable sled connected to said carriage and movable parallel to the longitudinal axis of said tube comprising the steps of:

generating a residual registration error signal;

generating a position change signal which is a function of said residual registration error signal, positioning said sled relative to said carriage before cutting, in response to said position change signal so as to minimize registration error with respect to said repeating pattern determining the registration error remaining at the time cutting occurs;

comparing said remaining registration error with preset limits; and rejecting the section of tube which was cut off if said remaining registration error exceeds said preset limits.

2. The improved method of claim 1 wherein the step of generating said residual registration error signal includes the step of determining short term error in the phase relationship between the motion of the carriage and the passage of the reference marks past said reference point.

3. The improved method of claim 2 wherein said step of determining the short term phase error includes the step of generating a signal which is a function of the amount of carriage motion occurring between the time a predetermined reference mark was expected to be sensed and the time said predetermined reference mark was actually sensed.

4. The improved method of claim 1 wherein the step of generating said residual registration error signal includes the step of determining registration error as a function of movement of the label wrap point along the longitudinal axis of said mandrel.

5. The improved method of claim 4 wherein the step of determining registration error as a function of movement of said wrap point includes the steps of:

measuring, at two spaced apart points, the distance from the edge of the label to a nominal wrapping line; and determining, as a function of said two distance measurements, the change in the position of said wrap point with respect to a nominal position of said wrap point included on said nominal wrapping line.

6. The improved method of claim 1 wherein the step of generating said residual registration error signal includes the step of determining registration error as a function of variations in the angle at which said label is wrapped onto said mandrel.

7. The improved method of claim 6 wherein said determination of said wrap angle registration error includes the steps of:

continuously measuring, at two spaced apart points, the distance from the edge of the label to a nominal wrapping line;

continuously measuring, at two spaced apart points, the distance from the edge of the mandrel to a nominal mandrel position line;

determining instantaneous registration error as a function of said distance measurements; and determining the average of said instantaneous registration error with respect to the length of the section of said tube between a nominal wrap point on the longitudinal axis of said tube and a nominal cut point on the longitudinal axis of said tube.

8. The improved method of claim 1 wherein the step of generating said residual registration error signal includes the step of determining registration error as a function of variations in the spacing between said reference marks.

9. The improved method of claim 8 wherein the step of determining registration error as a function of variations in the spacing between reference marks includes the steps of:

sensing the passage of a first reference mark past a first reference point which is along the path of travel of said reference marks;

sensing the passage of a second reference mark, which is adjacent to said first reference mark, past a second reference point which is located along the path of travel of said reference marks and a distance from said first reference point which is equal to the nominal spacing between reference marks;

measuring the amount of label travel during the time between the sensing of the passage of said first and second reference marks, said label travel representing the difference between the nominal spacing and the actual spacing between said first and second reference marks;

determining instantaneous registration error as a function of the measured amount of label travel; and determining the average of said instantaneous registration error with respect to the length of the section of said tube between a nominal wrap point on the longitudinal axis of said tube and a nominal cut point on the longitudinal axis of said tube.

10. The improved method of claim 1 wherein the step of generating said residual registration error signal includes the step of determining registration error as a function of errors in the phase relationship between the motion of said carriage and the motion of said label occurring between the sensing of the passage of a predetermined reference mark and the cutting of the tube.

11. The improved method of claim 10 wherein the step of determining registration error as a function of the phase relationship between the motion of said carriage and the motion of said label includes the steps of:

sensing the passage of said predetermined reference mark past said reference point;

measuring the instantaneous difference between the amount of travel of the carriage and amount of travel of the label from the time said predetermined reference mark is sensed; and determining registration error as a function of the instantaneous difference between the amount of travel of said carriage and said label.

12. In a method for producing spirally wound containers wherein a plurality of layers of material are spirally wound onto a mandrel to form a tube, the outside layer of said material being a label having a repeating pattern and equally spaced reference marks located along its length, wherein sections of said tube which include a plurality of container bodies defined by said pattern are severed in register with said pattern by cutting means connected to a reciprocating carriage which moves parallel to the longitudinal axis of said tube, wherein registration is controlled by maintaining the long term phase relationship between the motion of said carriage and the sensing of the passage of said reference marks past a reference point, and wherein said sections of the tube are later recut into individual container bodies having a fixed length, an improved method wherein said cutting means are carried by a movable sled connected to said carriage and movable parallel to the longitudinal axis of said tube comprising the steps of:

determining a first residual registration error as a function of variations in the length of said sections of the tube;

determining a second residual registration error as a function of factors other than variations in the length of said sections of the tube;

generating a position change signal corresponding to one-half of said first residual registration error and all of said second residual registration error; and positioning said sled with respect to said tube in response to said position change signal shortly before cutting, so as to minimize the registration error with respect to said container bodies.

13. The method of claim 12 further comprising the steps of:

generating a sled travel signal as a function of the amount of travel of said sled which has occurred before cutting begins;

generating a repositioning error signal which represents the difference between said position change signal and said sled travel signal;

comparing said repositioning error signal to preset limits; and rejecting the section of tube which was cut off if said repositioning error signal exceeds said preset limits.

14. In an apparatus for forming spirally wound containers from a plurality of spirally wound layers of material, the outside layer of which is a label having a repeating pattern which includes a plurality of generally equally spaced apart reference marks located along its length, wherein means are provided for spirally winding said material onto a mandrel to form a tube, wherein cutting means connected to a reciprocating carriage which moves parallel to the longitudinal axis of said tube are provided for severing sections of said tube in register with said pattern, and wherein registration is controlled by means for maintaining the long term phase relationship between the motion of the carriage and the sensing of the passage of the reference marks past a reference point, the improvement comprising:

a movable sled located on said carriage and carrying said cutting means, said sled being movable parallel to the longitudinal axis of said tube;

means for determining a residual registration error;

means for generating a position change signal which is a function of said residual registration error;

means for generating a sled travel signal as a function of the amount of travel of said sled which has occurred before cutting begins;

means for generating a repositioning error signal representing the difference between said position change signal and said sled travel signal;

means for comparing said repositioning error signal to preset limits;

means for positioning said movable sled with respect to said tube before cutting in response to said position change signal so as to minimize the registration error with respect to said pattern; and means for rejecting the section of tube which was cut off if said repositioning error signal exceeds said preset limits.

15. The improvement of claim 14 wherein said means for determining said residual registration error includes means for determining short term error in the phase relationship between the motion of the carriage and the passage of the reference marks past said reference point.

16. The improvement of claim 15 wherein said means for determining short term phase error includes means for generating a signal which is a function of the amount of carriage motion occurring between the time a predetermined reference mark was expected to be sensed and the time said predetermined reference mark was actually sensed.

17. The improvement of claim 14 wherein said means for determining residual registration error includes means for determining registration error as a function of movement of the wrap point of the label along the longitudinal axis of said mandrel.

18. The improvement of claim 17 wherein said means for determining said wrap point variation error includes:

means for measuring the distance, at two spaced apart points, from the edge of the label to a nominal wrapping line; and means for determining as a function of said two distance measurements, the change in wrap point with respect to a nominal wrap point included on said nominal wrapping line.

19. The improvement of claim 14 wherein said means for determining said residual registration error includes means for determining registration error as a function of variations in the angle at which said label is wrapped onto said mandrel.

20. The improvement of claim 19 wherein said means for determining wrap angle variation registration error includes:

means for continuously measuring, at two spaced apart points, the distance from the edge of the label to a nominal wrapping line;

means for continuously measuring, at two spaced apart points, the distance from the edge of the mandrel to a nominal mandrel position line;

means for determining instantaneous registration error as a function of said distance measurements; and means for determining the average of said instantaneous registration error with respect to the length of the section of said tube between a nominal wrap point on the longitudinal axis of said tube and a nominal cut point on the longitudinal axis of said tube.

21. The improvement of claim 14 wherein said means for determining residual registration error includes means for determining registration error as a function of variations in the spacing between said reference marks.

22. The improvement of claim 21 wherein said means for determining spacing variation registration error includes:

means for sensing the passage of a first reference mark past a first point;

means for sensing the passage of a second reference mark, which is adjacent to said first reference mark, past a second point, said first and second point being located along the line of travel of said reference marks and a distance apart from each other which is equal to the nominal spacing between reference marks;

means for measuring the amount of label travel during the time between the sensing of the passage of said first and second reference marks past their respective sensing points, so as to determine the difference between the nominal spacing and the actual spacing between said adjacent pair of reference marks;

means for determining instantaneous registration error as a function of said difference between said nominal and actual spacing; and means for determining the average of said instantaneous registration error with respect to the length of the section of said tube between a nominal wrap joint on the longitudinal axis of said tube and a nominal cut point on the axis of said tube.

23. The improvement of claim 14 wherein said means for determining residual registration error includes means for determining registration error as a function of errors in the phase relationship between the motion of said carriage and the motion of said label occurring after the sensing of the passage of a predetermined reference mark before cutting.

24. The improvement of claim 23 wherein said means for determining residual registration error as a function of the phase relationship between the motion of said carriage and the motion of said label includes:

means for sensing the passage of said predetermined reference mark past said reference point before cutting occurs;

means for measuring the instantaneous difference between the amount of travel of the carriage and amount of travel of the label from the time said predetermined reference mark is sensed; and means for determining registration error as a function of said difference between amount of travel of the carriage and amount of travel of the label.

25. In an apparatus for forming spirally wound containers a plurality of spirally wound layers of material, the outside layer of which is a label having a repeating pattern which includes a plurality of generally equally spaced reference marks located along its length, wherein means are provided for spirally winding said material onto a mandrel to form a tube, wherein cutting means, connected to a reciprocating carriage which moves parallel to the longitudinal axis of said tube, are provided for severing sections of said tube which include a plurality of container bodies defined by said pattern, said sections being severed in register with respect to said pattern and later being recut into individual container bodies, and wherein registration is controlled by means for maintaining the long term phase relationship between the motion of said carriage and passage of said reference marks past a reference point, the improvement comprising:

a movable sled located on said carriage and carrying said cutting means, said sled being movable parallel to the longitudinal axis of said tube;

means for determining a first residual registration error which is a function of variations in the length of said sections of the tube;

means for determining a second residual registration error which is a function of factors other than variations in the length of said sections of the tube;

means for generating a position change signal which corresponds to one-half of said first residual registration error and all of said second residual registration error; and means for repositioning said sled in response to said position change signal, so as to minimize registration error in each container when said sections are recut into individual containers.

26. The improvement of claim 25 further including:

means for generating a sled travel signal as a function of the amount of travel of said sled in response to said position change signal which has occurred when cutting begins;

means for generating a repositioning error signal which represents the difference between said position change signal and said sled travel signal;

means for comparing said repositioning error signal to preset limits; and means for rejecting the section of tube which was cut off if said repositioning error signal exceeds said preset limits.

27. The improvement of claim 25 wherein said means for repositioning said moveable sled includes a stepping servomotor.

28. The improvement of claim 14 wherein said means for repositioning said movable sled includes a stepping servomotor.

29. In an apparatus for forming spirally wound containers from a plurality of spirally wound layers of material, the outside layer of which is a label having a repeating pattern which includes a plurality of generally equally spaced apart reference marks located along its length, wherein means are provided for spirally winding said material onto a mandrel to form a tube, wherein cutting means connected to a reciprocating carriage which moves parallel to the longitudinal axis of said tube are provided for severing sections of said tube in register with said pattern, and wherein registration is controlled by means for maintaining the long term phase relationship between the motion of the carriage and the sensing of the passage of the reference marks past a reference point, the improvement comprising:

a movable sled located on said carriage and carrying said cutting means, said sled being movable parallel to the longitudinal axis of said tube;

means for determining a residual registration error, including means for generating a signal which is a function of the amount of carriage motion occurring between the time a predetermined reference mark was expected to be sensed and the time said predetermined reference mark was actually sensed;

means for generating a position change signal which is a function of said residual registration error; and means for positioning said movable sled with respect to said tube before cutting in response to said position change signal so as to minimize the registration error with respect to said pattern.

* * * * *